US006294303B1

(12) United States Patent
Putnam et al.

(10) Patent No.: US 6,294,303 B1
(45) Date of Patent: Sep. 25, 2001

(54) MONOCOMPONENT DEVELOPER CONTAINING POSITIVELY CHARGEABLE FINE POWER

(75) Inventors: David Daniel Putnam, Fairport; Dana G. Marsh, Newark; Robert E. Contois, Rochester, all of NY (US)

(73) Assignee: Nexpress Solutions LLC, Rochester, NY (US)

( * ) Notice: Subject to any disclaimer, the term of this patent is extended or adjusted under 35 U.S.C. 154(b) by 0 days.

(21) Appl. No.: 09/489,811

(22) Filed: Jan. 24, 2000

(51) Int. Cl.[7] ..... G03G 9/097
(52) U.S. Cl. ..... 430/110; 430/120
(58) Field of Search ..... 430/106.6, 110, 430/120

(56) References Cited

U.S. PATENT DOCUMENTS

| | | | |
|---|---|---|---|
| 2,297,691 | 10/1942 | Carlson | 95/5 |
| 3,998,160 | 12/1976 | Pearce | 101/426 |
| 4,449,168 | 5/1984 | Ewing | 362/404 |
| 4,824,752 | 4/1989 | Yasuda et al. | 430/106.6 |
| 4,859,550 | 8/1989 | Gruber et al. | 430/110 |
| 5,348,829 | 9/1994 | Uchiyama et al. | 430/106.6 |
| 5,364,722 | 11/1994 | Tanikawa et al. | 430/110 |
| 5,658,991 | 8/1997 | Kosaka et al. | 525/221 |
| 5,747,213 | 5/1998 | Okada et al. | 430/124 |
| 5,811,214 * | 9/1998 | Osterhoudt et al. | 430/106.6 |

* cited by examiner

*Primary Examiner*—John Goodrow

(57) ABSTRACT

A monocomponent electrostatographic developer is disclosed. The developer contains a negatively charging toner wherein the toner particle surface contains a positively chargeable inorganic fine powder having a mean volume average diameter of 0.5 to 7.0 $\mu$m, a cleaning ratio of 0.1 to 5.0, and a flowability improving agent having a BET specific surface area of at least 30 $m^2/g$. A method of electrostatic imaging using the developer is also disclosed.

18 Claims, No Drawings

MONOCOMPONENT DEVELOPER CONTAINING POSITIVELY CHARGEABLE FINE POWER

FIELD OF THE INVENTION

This invention relates to electrostatography, particularly toners for electrostatographic image development methods.

DESCRIPTION RELATIVE TO THE PRIOR ART

In electrostatography, an image comprising a pattern of electrostatic potential (also referred to as an electrostatic latent image), is formed on a surface of an electrophotographic element and is then developed into a toner image by contacting the latent image with an electrophotographic developer. If desired, the latent image can be transferred to another surface following development. The toner image may be transferred to a receiver, to which it is fused, typically by heat and pressure.

Electrostatographic developers can be monocomponent or two component developers. Two component developers comprise a mixture of carrier and toner particles. Monocomponent developers comprise nonmagnetic or magnetic toner particles but do not have separate carrier particles. Monocomponent developers can have additional components such as flow agents, and cleaning aids.

Cleaning aids in monocomponent developers are present to prevent an accumulation of toner or toner components on photoconductive elements. Silica, titania, alumina, zirconium oxide and cerium dioxide among others are disclosed as cleaning aids.

U.S. Pat. No. 4,824,752 discloses use of cerium oxide particles with the function of disintegrating silicon dioxide particulates thereby enhancing the attachment thereof to the toner particles. The hydrophobic silicon dioxide particulates provide flowability to the toner particles and assist in the negative chargeability. The hydrophobic silicon dioxide particulates also serve as an abrasive in a cleaning step.

U.S. Pat. No. 5,348,829 discloses a problem in noncontact monocomponent development in which development performance is degraded due to an increased force of attachment of magnetic toner particles in the vicinity of the developing roll sleeve surface. When a monocomponent-type developer comprising an external mixture of a magnetic toner and inorganic fine powder is used, the inorganic fine powder is selectively applied in the vicinity of the developer roll sleeve to form a very thin layer of the inorganic fine powder. As a result, the magnetic toner does not directly contact the developer roll sleeve surface, so that the magnetic toner is prevented from sticking onto the sleeve surface due to an image force, thus not being liable to cause a coating irregularity of the developer. This patent discloses that a fine powder of strontium titanate shows excellent results.

These and other prior art monocomponent developers fail to provide outstanding image quality, good fusing to receivers, acceptable release from the fusing member, and adequate suppression of contamination of photoconductor and developer roll sleeve surfaces. Many image quality artifacts are associated with and caused by contamination of the surface of the developer roll sleeve, or by the accumulation of magnetic toner or other inorganic fine particles in the vicinity of the developer roll sleeve. These image quality artifacts are not completely suppressed by the use of strontium titanate or other cleaning aids or abrasive surface additives disclosed in the prior art.

SUMMARY OF THE INVENTION

The present invention is an improved monocomponent electrostatographic developer. The developer includes negatively charging toner particles. The particles include a polymeric binder and magnetic material wherein the toner particle surface contains particles of positively chargeable inorganic fine powder particles. The invention is characterized in that:

- the inorganic fine powder particles have a mean volume average particle size of about 0.5 to 7 $\mu$m, and a cleaning ratio between 0.1 and 5.0;
- the cleaning ratio being the volume fraction of particles between 0 and 1.0 $\mu$m, divided by the volume fraction of particles greater than 1.0 $\mu$m; and
- the particles having on the surface thereof a flowability improving agent having a BET surface area of at least 30 $m^2/g$.

This developer provides outstanding image quality, superior fusing to receivers, acceptable release from the fusing member, excellent suppression of photoconductor contamination, and excellent suppression of developer roll sleeve contamination.

DETAILED DESCRIPTION OF THE INVENTION

The toners of the monocomponent developer composition of the invention contain a polymeric binder and magnetic material. Optionally the toner may include a charge control agent, a release agent such as a wax, colorants and other additives.

As noted above, it is conventional to include a cleaning aid in a monocomponent developer composition. We have found that certain specific characteristics of the cleaning aid and other features provide for improved results. In preparing the monocomponent composition of the invention the toner is first treated with a flowability improvement agent, such as silicon dioxide. Thereafter the toner is treated with a positively chargeable inorganic fine powder (IFP). In the first step the toner surface is treated with 0.2 to 1.0 weight percent silicon dioxide based on the weight of the toner, the silicon dioxide having a BET surface area of at least 30 $m^2/g$. In the second step the toner is treated with from 1.0 to 6.0 weight percent IFP based on the total weight of the mixture of toner and silicon dioxide.

The flowability improvement agent can be treated silica dioxide. A useful treated silicon dioxide is hexamethyldisalizane treated silicon dioxide that is commercially available from Degussa Corporation as Aerosil™ R8 12. The IFP added to the developer can be pure cerium dioxide, pure strontium titanate or cerium oxide-rich or strontium titanate rich polishing aids. Useful positively chargeable inorganic fine powders have a mean volume average particle size of about 0.5 to 7 $\mu$m. Cerium dioxide rich polishing aids are commercially available from Ferro Electronic Materials. Strontium Titanate (99% pure) is available from Sigma-Aldrich. Milling or classification of the IFP or combinations of milled and classified IFPs can also be accomplished to produce the desired particle size distribution. SRS135 from Ferro Electronic materials is a milled version of their SRS123. SRS123C was classified by CCE technologies from SRS123. A useful composition is a mixture of SRS 123C and SRS 135 in the ratio 30:70 to 70:30 by weight.

The inorganic fine powder (IFP) added to the developer can be a pure material or mixtures of materials. Cerium dioxide or mixtures of cerium dioxide may be used advantageously as cleaning aids to ensure that the photoconductive element is not contaminated and to ensure that the surface of the developer roll sleeve is not scummed or otherwise contaminated. The positively chargeable inorganic fine powder is attracted to the vicinity of the surface of the developer roll sleeve during the development process. The cerium dioxide effectively cleans the surface of the developer roll sleeve and removes any toner or other contaminates.

Contamination of the surface of the developer roll sleeve degrades image quality. Toner or other materials that become physically attached to the surface of the developer roll sleeve will result in decreasing the charge-to-mass of the toner by interfering with the triboelectric interaction between the surface of the toner particle and the surface of the developer roll sleeve. The poorly charged toner particles will not develop onto the image areas of the photoconductor and image reflection density will be lowered and background increased. In addition, the presence of attached (scummed) toner on the surface of the developer roll sleeve will cause localized irregularities in the surface of the toner on the developer roll sleeve. These surface irregularities may in some cases result in reproduction of non-uniform solid area density particularly for low-density originals.

To avoid image quality degradation due to contamination of the developer roll sleeve, appropriate positively chargeable inorganic fine powder (IFP) cleaning aids must be employed. The appropriate weight percent of cleaning aid based on toner weight must be used. Preferrably, the weight percent cleaning aid is between about 1.0 wt. % and 6.0 wt. %. If the cleaning aid is added in an amount below about 1.0 wt. %, insufficient IFP cleaning aid may be available in the region of the surface of the developer roll sleeve surface and scumming and contamination may occur. This might result in degradation of image quality. On the other hand, if cleaning aid is added in an amount above about 6.0 wt. %, the cleaning aid may not be adequately attached to the surface of the toner, and machine contamination may occur. In addition, triboelectric charging between the surface of the toner and the surface of the developer roll sleeve may be prevented resulting in low charge-to-mass of the toner and low image density. The preferred amount is between about 2.0 to 4.0 weight percent of positively charging inorganic fine powder particles.

According to the present invention, we have found that the particle size distribution (PSD) of the cleaning aid must be carefully controlled. The mean volume average diameter of the cleaning aid must be maintained between an upper and lower limit. If the mean volume average particle size of the particles in the powder of the cleaning aid is below about 0.5 $\mu$m, image density may be degraded. On the other hand, if the mean volume average particle size of the cleaning aid is above about 7.0 $\mu$m, the cleaning aid is not efficient in preventing contamination on the surface of the developer roll sleeve.

Also according to the present invention we have found that the range of the volume mean particle size of the cleaning aid and the ratio of particle sizes below and above 1.0 $\mu$m mean volume average diameter must be controlled. The "cleaning ratio" must be controlled in the range of about 0.1 to 5.0. The cleaning ratio is defined as the volume fraction of particles between 0 and 1.0 $\mu$m, divided by the volume fraction of particles greater than 1.0 $\mu$m. Stated as a formula:

$$\text{Cleaning Ratio} = \text{volume fraction } 0 \text{ to } 1.0\ \mu\text{m}/\text{volume fraction} > 1.0\ \mu\text{m}$$

A cleaning aid with cleaning ratio below 0.1 has a high proportion of large particles. This situation results in good image density and background image quality. A cleaning aid ratio greater than about 4.0, has a high proportion of small particles. This condition results in decreasing toner laydown onto the surface of the developer roll sleeve, reduced charge-to-mass of the toner, non-uniform solid area image density, lowered image density, and higher background. The preferred cleaning ratio is between about 0.76 to 4.0.

In a typical manufacturing process, the desired polymeric binder for toner application is produced. Polymeric binders for electrostatographic toners are commonly made by polymerization of selected monomers followed by mixing with various additives and then grinding to a desired size range. During toner manufacturing, the polymeric binder is subjected to melt processing in which the polymer is exposed to moderate to high shearing forces and temperatures in excess of the glass transition temperature of the polymer. The temperature of the polymer melt results, in part, from the frictional forces of the melt processing. The melt processing includes melt-blending of toner addenda, including the magnetic material, into the bulk of the polymer.

The polymer may be made using a limited coalescence reaction such as the suspension polymerization procedure disclosed in U.S. Pat. No. 4,912,009 to Amering et al.

Useful binder polymers include vinyl polymers, such as homopolymers and copolymers of styrene. Styrene polymers include those containing 40 to 100 percent by weight of styrene, or styrene homologs, and from 0 to 40 percent by weight of one or more lower alkyl acrylates or methacrylates. Also included are fusible styrene-acrylic copolymers that are covalently lightly crosslinked with a divinyl compound such as divinylbenzene. Binders of this type are described, for example, in U.S. Reissue Pat. No. 31,072. Preferred binders comprise styrene and an alkyl acrylate and/or methacrylate and the styrene content of the binder is at least 60% by weight.

Copolymers rich in styrene such as styrene butylacrylate and styrene butadiene are also useful as binders as are blends of polymers. In such blends the ratio of styrene butylacrylate to styrene butadiene can be 10:1 to 1:10. Ratios of 5:1 to 1:5 and 7:3 are particularly useful. Polymers of styrene butylacrylate and/or butylmethacrylate (30 to 80% styrene) and styrene butadiene (30 to 80% styrene) are also useful binders.

Styrene polymers include styrene, alpha-methylstyrene, para-chlorostyrene, and vinyl toluene; and alkyl acrylates or methylacrylates or monocarboxylic acids having a double bond selected from the group consisting of acrylic acid, methyl acrylate, 2-ethylhexyl acrylate, 2-ethylhexyl methacrylate, ethyl acrylate, butyl acrylate, dodecyl acrylate, octyl acrylate, phenylacrylate, methylacrylic acid, ethyl methacrylate, butyl methacrylate and octyl methacrylate are also useful binders. Also useful are condensation polymers such as polyesters and copolyesters of aromatic dicarboxylic acids with one or more aliphatic diols, such as polyesters of isophthalic or terephthalic acid with diols such as ethylene glycol, cyclohexane dimethanol and bisphenols A useful binder can also be formed from a copolymer of a vinyl aromatic monomer; a second monomer selected from either conjugated diene monomers or acrylate monomers such as alkyl acrylate and alkyl methacrylate.

The magnetic materials included in the monocomponent toner of the invention are generally of the soft type magnetic materials disclosed in the prior art. Examples of useful magnetic materials include mixed oxides of iron, iron silicon alloys, iron aluminum, iron aluminum silicon, nickel iron molybdenum, chromium iron, iron nickel copper, iron cobalt, oxides of iron and magnetite.

Release agents are useful additives in monocomponent toner compositions. Useful release agents are well known in this art. Useful release agents include low molecular weight polypropylene, natural waxes, low molecular weight synthetic polymer waxes, commonly accepted release agents, such as stearic acid and salts thereof, and others. More specific examples are copolymers of ethylene and propylene having a molecular weight 1000–5000 g/mole, particularly a copolymer of ethylene and propylene having a molecular weight about 1200 g/mole.

An optional additive for the toner is the charge control agent. The term "charge-control" refers to a propensity of a toner addendum to modify the triboelectric charging properties of the resulting toner. A very wide variety of charge control agents for positive and negative charging toners are available. Suitable charge control agents are disclosed, for example, in U.S. Pat. Nos. 3,893,935; 4, 079,014; 4,323, 634; 4,394,430 and British Patent Nos. 1, 501,065; and 1,420,839. Additional charge control agents which are useful are described in U.S. Pat. No. 4,624,907; 4,814,250; 4,840,864; 4,834,920; 4,683,188 and 4,780,553. Mixtures of charge control agents can also be used. Particular examples of charge control agents include chromium salicylate organo-complex salts, and azo-iron complex-salts, an azo-iron complex-salt, particularly ferrate (1-), bis[4-[(5-chloro-2-hydroxyphenyl)azo]-3-hydroxy-N-phenyl-2-naphthalenecarboxamidato(2-)], ammonium, sodium and hydrogen (Organoiron available from Hodogaya Chemical Company Ltd.).

Another optional additive for the toner is a colorant. In some cases the magnetic component acts as a colorant negating the need for a separate colorant. Suitable dyes and pigments are disclosed, for example, in U.S. Reissue Pat. No. 31,072 and in U.S. Pat. No. 4,160,644; 4,416,965; 4,414,152; and 2,229,513. One particularly useful colorant for toners to be used in black and white electrostatographic copying machines and printers is carbon black. Colorants are generally employed in the range of about 1 to about 30 weight percent on a total toner powder weight basis, and preferably in the range of about 2 to about 15 weight percent.

The developer of the invention is generally made in several steps. In the first step the polymer, magnetic material, release agent are melt blended in a two roll mill or an extruder. The blend is ground, and classified to achieve a particular toner size distribution. The toner has a number average median diameter between 3 to 15 $\mu$m, or has a volume average median diameter between 5 and 20 $\mu$m. The desired toner has a number average median diameter between 6.5 to 8.5 $\mu$m and a volume average median diameter between 8.5 to 10.5 $\mu$m . To the toner is added the mixture of silicon dioxide particles and positively chargeable inorganic fine powder and mixed according to the procedural steps described above and exemplified in the following examples. Mixing can be carried out in a high-speed mixer, such as a Henschel mixer. As stated above the silicon dioxides are added in a first mixing step and particles of positively chargeable inorganic fine powder in a second mixing step.

The toner comprises, based on the weight of the toner, 40 to 60% polymer; 30 to 55% magnetic material; optionally 1 to 5% release agent; and the concentration of silicon dioxide and positively chargeable inorganic fine powder described above.

The toner can also contain other additives of the type used in previous toners, including magnetic pigments, leveling agents, surfactants, stabilizers, and the like.

The term "particle size" used herein, or the term "size", or "sized" as employed herein in reference to the term "toner particles", means the median volume average diameter as measured by conventional measuring devices, such as a Coulter Multisizer, sold by Coulter, Inc. of Hialeah, Fla. The term positively chargeable inorganic fine powder particle size refers to the mean volume average diameter as measured by a laser scattering particle size distribution analyzer, such as the Horiba LA910, sold by Horiba Instruments.

Analytical Methods

Particle size distribution

The particle size distribution of the positively chargeable inorganic fine powder (IFP) is measured by means of a laser scattering particle size distribution analyzer (such as the Horiba LA910 available from Horiba instruments). For measurement, 0.5 to 5 g is dispersed with around 50 mL of a 0.25% Tamol SN aqueous solution from Rohm and Haas Company (or other suitable dispersant). The dispersed sample is then subjected to measurement. The Horiba LA910 analyzer is run with the ultrasonics on at a power level output setting of 3 and circulation setting of 3. The particle size distributions used in the examples, were all measured by Ferro Electronic Materials according to the method described above. From the particle size distribution the mean volume average particle size can be calculated. An effective cleaning ratio is calculated from the volume distribution. The cleaning ratio is the fraction of particles between 0 and 1 $\mu$m mean volume average diameters, divided by the fraction of particles greater than 1 $\mu$m mean volume average diameter.

BET Surface Area

The surface area of the flowability improving agent is measured by means of a multipoint BET surface area device, such as the Gemini 2370® available from Micromeritics Instrument Corporation. (See Brunauer, S., Emmet, P. H., and Teller, E., J. Am. Chem. Soc., 60(309), 1938) The surface are is calculated by measuring the quantity of nitrogen gas that adsorbs as a monolayer on the surface of the sample. The resulting surface area value is a multipoint BET value and is given in $m^2/g$. The reported surface area is an average of two measurements. The surface area of the Aerosil™ R812 silica dioxide flowability improvement agent used in the examples, was measured by Degussa Corporation according to this method.

The following examples are presented for a better understanding of the positively chargeable inorganic fine powders of the invention and the developer formulation used to evaluate them. IFPs used in the examples are listed in Table 1.

TABLE 1

| IFP | Product Name | Manufacturer |
|---|---|---|
| Strontium Titanate | 396141 | Sigma-Aldrich Corporation |
| Cerium Dioxide rich | TRS2005 | Ferro Electronic Materials |
| Cerium Dioxide rich | SRS135 | Ferro Electronic Materials |
| Cerium Dioxide rich | SRS123C | Classified version of SRS123 from Ferro Electronic Materials* |

*classification done by CCE technologies.

A toner was prepared according to the formulation recipe below:

| Monocomponent Toner Core Production | |
|---|---|
| Styrene butylacrylate/butylmethacrylate copolymer | 38.8wt% |
| Styrene butadiene copolymer | 16.5wt% |
| Magnetite | 43.7wt% |
| Ethylene-propylene copolymer wax | 1.0wt% |

The above materials were melt blended on a twin screw extruder at about 200 C. average melt temperature to yield a uniform dispersion. The blended material was then jet milled and classified to give a toner product volume median average diameter of about 9.0 to 9.5 $\mu$m.

Monocomponent Toner Developer Production

The toner prepared as described above was blended in a two step operation with a silicon dioxide in the first step and a positively chargeable inorganic fine powder in the second step. The mixture was effected using a Henschel high intensity mixer. In step 1 of the surface treatment, 0.65% by weight of the silicon dioxide was dry blended with the core toner under high shear conditions. In the second step also under high shear conditions, 2.5 parts by weight of the IFP was dry blended with 100 parts of toner and $SiO_2$ from step 1 above to yield the final developer.

Table 2 describes the performance of the developers made with the different IFPs in the following examples.

EXAMPLE 1

1.75 parts of cerium oxide rich SRS135 and 0.75 parts of cerium oxide rich SRSl23C were blended with 100 parts of toner from step 1 of the surface treatment using a Henschel high intensity mixer. The developer was subjected to a 25 kilocopy print full system printing test on an Kodak IS50 mid-volume copier and the printed copies were evaluated for image quality at 0, 1, 5, 15 and 25 kilocopies. Image quality was reported as an average reflection density, average background, and average density uniformity. The developer roll sleeve was also observed during the test for any scumming defects. If a scumming defect was present on the developer roll sleeve the printed copies were evaluated to see if the defect imaged in the copy. Excellent image quality was obtained, and no developer roll sleeve scumming defects were observed using the composition of this example.

EXAMPLE 2

2.5 parts of cerium oxide rich SRS 135 was blended with 100 parts of toner from step 1 of the surface treatment using a Henschel high intensity mixer. The developer was subjected to a 25 kilocopy print full system printing test on an Kodak IS50 mid-volume copier and the printed copies were evaluated for image quality at 0, 1, 5, 15 and 25 kilocopies. Image quality was reported as an average reflection density, average background, and average density uniformity. The developer roll sleeve was also observed during the test for any scumming defects. If a scumming defect was present on the developer roll sleeve the printed copies were evaluated to see if the defect imaged in the copy. Excellent image quality was obtained using the composition of this example. A single minor developer roll sleeve scumming defect was observed that was not present in the printed copies.

EXAMPLE 3

2.5 parts of cerium oxide rich TRS2005 was blended with 100 parts of toner from step 1 of the surface treatment using a Henschel high intensity mixer. The developer was subjected to a 25 kilocopy print full system printing test on an Kodak IS50 mid-volume copier and the printed copies were evaluated for image quality at 0, 1, 5, 15 and 25 kilocopies. Image quality was reported as an average reflection density, average background, and average density uniformity. The developer roll sleeve was also observed during the test for any scumming defects. If a scumming defect was present on the developer roll sleeve the printed copies were evaluated to see if the defect imaged in the copy. Low reflection density and high density non-unifonnity was observed. No developer roll sleeve scumming defects were observed.

COMPARATIVE EXAMPLE 4

2.5 parts of cerium oxide rich SRS123C was blended with 100 parts of toner from step 1 of the surface treatment using a Henschel high intensity mixer. The developer was subjected to a 25 kilocopy print full system printing test on an Kodak IS50 mid-volume copier and the printed copies were evaluated for image quality at 0, 1, 5, 15 and 25 kilocopies. Image quality was reported as an average reflection density, average background, and average density uniformity. The developer roll sleeve was also observed during the test for any scumming defects. If a scumming defect was present on the developer roll sleeve the printed copies were evaluated to see if the defect imaged in the copy. Excellent image quality was obtained. However, several developer roll sleeve scumming defects were observed and imaged in the printed copies.

COMPARATIVE EXAMPLE 5

2.5 parts of 99% pure strontium titanate 396141was blended with 100 parts of toner from step 1 of the surface treatment using a Henschel high intensity mixer. The developer was subjected to a 25 kilocopy print full system printing test on an Kodak IS50 mid-volume copier and the printed copies were evaluated for image quality at 0, 1, 5, 15 and 25 kilocopies. Image quality was reported as an average reflection density, average background, and average density uniformity. The developer roll sleeve was also observed during the test for any scumming defects. If a scumming defect was present on the developer roll sleeve the printed copies were evaluated to see if the defect imaged in the copy. Excellent image quality was obtained. However, several developer roll sleeve scumming defects were observed and imaged in the printed copies.

TABLE 2

| | Mean Volume Average Diameter, microns | Cleaning Ratio | Developer Roll Sleeve Toner Laydown avg., mg/cm$^2$ | Charge-to-mass Average, $\mu$C/g |
|---|---|---|---|---|
| Example 1 Cerium Dioxide rich (70% SRS135, 30% SRS123C) | 2.12 | 0.76 | 1.98 | 9.9 |
| Example 2 Cerium Dioxide rich SRS135 | 1.07 | 1.43 | 1.38 | 9.2 |
| Example 3 Cerium Dioxide rich TRS2005 | 0.78 | 4.00 | 1.05 | 9.1 |

TABLE 2-continued

| | | | | |
|---|---|---|---|---|
| Comparative Example 4 Cerium Dioxide rich SRS123C | 6.30 | 0.04 | 1.94 | 10.2 |
| Comparative Example 5 Strontium Titanate 396141 | 1.52 | 0.40 | 1.61 | 9.9 |

| | Reflection Density Average | Reflection Density Uniformity Average* | Background, RMSGS* Average | Developer Roll Sleeve Scumming Defect |
|---|---|---|---|---|
| Example 1 Cerium Dioxide rich (70% SRS135, 30% SRS123C) | 1.58 | 0.02 | 2.3 | none |
| Example 2 Cerium Dioxide rich SRS135 | 1.55 | 0.02 | 2.6 | Non-imaging single defect |
| Example 3 Cerium Dioxide rich TRS2005 | 1.49 | 0.08 | 1.7 | none |
| Comparative Example 4 Cerium Dioxide rich SRS123C | 1.58 | 0.02 | 2.6 | Several imaging defects |
| Comparative Example 5 Strontium Titanate 396141 | 1.55 | 0.01 | 2.7 | Several imaging defects |

• Reflection Density Uniformity is the standard deviation of the reflection density for a .6 grey document divided by the average reflection density for the document (CV).
• Root Mean Square Granularity Scale

What is claimed is:

1. In a monocomponent electrostatographic developer comprising negatively charging toner particles comprising a polymeric binder and magnetic material and wherein the toner particle surface contains particles of positively chargeable inorganic fine powder particles, the improvement wherein:

said inorganic fine powder particles have a mean volume average particle size of about 0.5 to 7 $\mu$m, and a cleaning ratio of between about 0.76 to 4.0;

said cleaning ratio being the volume fraction of particles between 0 and 1.0 $\mu$m, divided by the volume fraction of particles greater than 1.0 $\mu$m; and the toner particles have on the surface thereof a flowability improving agent having a BET surface area of at least 30 $m^2/g$.

2. The developer of claim 1 wherein the toner surface contains based on the weight of toner, (a) from about 0.2 to 1.0 total weight percent of flowability improving agent and (b) from about 1.0 to 6.0 weight percent of positively chargeable inorganic fine powder particles.

3. The developer of claim 2 wherein the toner surface contains from about 2.0 to 4.0 weight percent of positively chargeable inorganic fine powder particles.

4. The developer of claim 1 wherein said flowability improving agent is hexamethyldisilazane treated silicon dioxide.

5. The developer of claim 1 wherein the positively chargeable inorganic fine powder particles comprise pure cerium oxide or cerium oxide rich particles.

6. The developer of claim 1 wherein the polymeric binder comprises styrene and an alkyl acrylate and/or methacrylate and the styrene content of the binder is at least 60% by weight.

7. The developer of claim 1 wherein the toner contains a release agent.

8. The developer of claim 7 wherein said release agent is a wax selected from low molecular weight polypropylenes, natural waxes, low molecular weight synthetic polymer waxes, stearic acid, and salts thereof.

9. The developer of claim 7 wherein the release agent is selected from a copolymer of ethylene and propylene having a molecular weight of 1000–5000 g/mole or a copolymer of ethylene and propylene having a molecular weight about 1200 g/mole.

10. A method of electrostatic imaging comprising the steps of:

forming an electrostatic latent image on a surface of an electrophotographic element; and developing the image by contacting the latent image with a monocomponent electrostatographic developer comprising negatively charging toner particles comprising a polymeric binder and magnetic material and wherein the toner particle surface contains particles of positively chargeable inorganic fine powder particles wherein:

said inorganic fine powder particles have a mean volume average particle size of about 0.5 to 7 $\mu$m, and a cleaning ratio between about 0.76 and 4.0;

said cleaning ratio being the volume fraction of particles between 0 and 1.0 $\mu$m, divided by the volume fraction of particles greater than 1.0 $\mu$m; and the toner particles have on the surface thereof a flowability improving agent having a BET surface area of at least 30 $m^2/g$.

11. The method of claim 10 wherein the toner surface contains based on the weight of toner, (a) from about 0.2 to 1.0 total weight percent of the flowability improving agent and (b) from about 1.0 to 6.0 weight percent of the positively chargeable inorganic fine powder particles.

12. The method of claim 10 wherein the toner surface contains from about 2.0 to 4.0 weight percent of the positively chargeable inorganic fine powder particles.

13. The method of claim 10 wherein said flowability improving agent is hexamethyldisilazane treated silicon dioxide.

14. The method of claim 10 wherein the positively chargeable inorganic fine powder particles comprise cerium oxide.

15. The method of claim 10 wherein the polymeric binder comprises a copolymer of styrene and at least one other monomer selected from alkyl acrylates, alkyl methacrylates, and mixtures thereof, and the styrene content of the binder is at least 60% by weight.

16. The method of claim 10 wherein the toner contains a release agent.

17. The method of claim 16 wherein the release agent is a wax selected from low molecular weight polypropylenes, natural waxes, low molecular weight synthetic polymer waxes, stearic acid, and salts thereof.

18. The method of claim 16 wherein the release agent is selected from a copolymer of ethylene and propylene having a molecular weight of 1000–5000 g/mole or a copolymer of ethylene and propylene having a molecular weight of about 1200 g/mole.

* * * * *